US007318741B2

(12) United States Patent
Wu

(10) Patent No.: US 7,318,741 B2
(45) Date of Patent: Jan. 15, 2008

(54) RIGHT ANGLE CABLE ASSEMBLY HAVING LOCKING MEMBER ON OPPOSITE SIDES THEREOF

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/480,129

(22) Filed: Jun. 29, 2006

(65) Prior Publication Data

US 2006/0246765 A1 Nov. 2, 2006

Related U.S. Application Data

(63) Continuation-in-part of application No. 10/787,661, filed on Feb. 25, 2004, now Pat. No. 6,991,487.

(51) Int. Cl.
*H01R 13/627* (2006.01)

(52) U.S. Cl. ..... 439/354

(58) Field of Classification Search ..... 439/354, 439/344, 352, 357, 358
See application file for complete search history.

(56) References Cited

U.S. PATENT DOCUMENTS 5,213,533 A 5/1993 Walden
5,727,963 A 3/1998 Lemaster
5,775,931 A 7/1998 Jones
5,860,826 A 1/1999 Chang
5,941,726 A 8/1999 Koegel et al.
6,099,339 A 8/2000 Yanagida et al.
6,210,202 B1 4/2001 Kuo
6,558,183 B1 5/2003 Ji et al.
6,565,383 B1 5/2003 Wu
6,585,536 B1 7/2003 Wu
6,585,537 B1 7/2003 Lee
6,641,425 B1 * 11/2003 Wu ..... 439/352
6,648,665 B1 * 11/2003 Wu ..... 439/352
6,648,666 B1 * 11/2003 Wu ..... 439/352
6,702,603 B2 * 3/2004 Wu ..... 439/352
6,773,293 B1 * 8/2004 Lee ..... 439/357
6,786,755 B2 9/2004 Dambach et al.
6,945,807 B1 * 9/2005 Wu ..... 439/354

* cited by examiner

*Primary Examiner*—Chandrika Prasad
(74) *Attorney, Agent, or Firm*—Wei Te Chung

(57) ABSTRACT

A cable assembly (1) includes an insulative housing (10), a number of contacts (20) disposed in the housing, an insulator (70) with a base (71) and a distal portion (72) extending upwardly from the base, a plurality of cables (40), and a cover (50), the cables comprises a plurality of conductors (43) received in the distal portion of the insulator, passing through the base and connected to a rear portion of the housing, the cover assembled on the rear portion of the housing, enclosing insulator, and has a body portion (510), and a receiving portion (511) behind the body portion, the base of the insulator are received of in the body portion, and the distal portion of the insulator are received in the receiving portion, said cables extend out of the cover from a lateral side thereof.

18 Claims, 13 Drawing Sheets

RIGHT ANGLE CABLE ASSEMBLY HAVING LOCKING MEMBER ON OPPOSITE SIDES THEREOF

CROSS-REFERENCE

This is related to U.S. patent application Ser. No. 10/787,661, filed on Feb. 25, 2004 now U.S. Pat. No. 6,991,487, and entitled "CABLE CONNECTOR ASSEMBLY HAVING LOCKING MEMBER" which have the same applicant and assignee as the present invention.

BACKGROUND OF THE INVENTION

1. Field of the Invention

The present invention relates to a cable assembly, and particularly to a cable assembly having a locking member for locking with a complementary connector.

2. Description of Prior Arts

There exists in the art a cable end connector assembly known as a Serial Advanced Technology Attachment (Serial ATA) connector which is generally used for disk drives and storage peripherals. Especially, the Serial ATA connectors according to the Serial ATA standard are featured in fewer counts of electrical contacts than other conventional electrical connectors and are relatively tiny in configuration. It is desirable for the Serial ATA connector to have latch means for providing a reliable mechanical and electrical connection with a complementary connector.

With the development of the Serial ATA standard, the next-generation serial storage interface effort expands the base Serial ATA 1.0 capabilities to address additional markets segments, including the server and networked storage markets. A cable assembly based on Serial ATA II standard is designed to connect with more devices and cables. As the connector is probably applied to a wider profile, an improved locking member of the Serial ATA connector is disclosed (U.S. patent application Ser. No. 10/787,661).

Obviously, it is desirable to improve the structure for retaining the improved locking member on a right angle electrical connector.

SUMMARY OF THE INVENTION

An object of the present invention is to provide a cable assembly having an improved locking member for locking the cable assembly with a complementary connector reliably.

To achieve the above object, a cable assembly for mating with a complementary connector in a front-to-back direction, comprises an insulative housing with a pair of first retention cavity, a plurality of contacts disposed in the housing, a plurality of cables extending along a left-to-right direction perpendicular to the front-to-back direction, a cover and a latching member. The cover assembled on the rear portion of the housing, and has a body portion, a receiving portion behind the body portion and a pair of opposite side portions with a pair of U-shaped second retention cavities therein, respectively, the first retention cavities aligned with the corresponding second retention cavities in the front-to-back direction; each locking member is received in the second retention cavities of the covers and extends into the first retention cavities of the housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
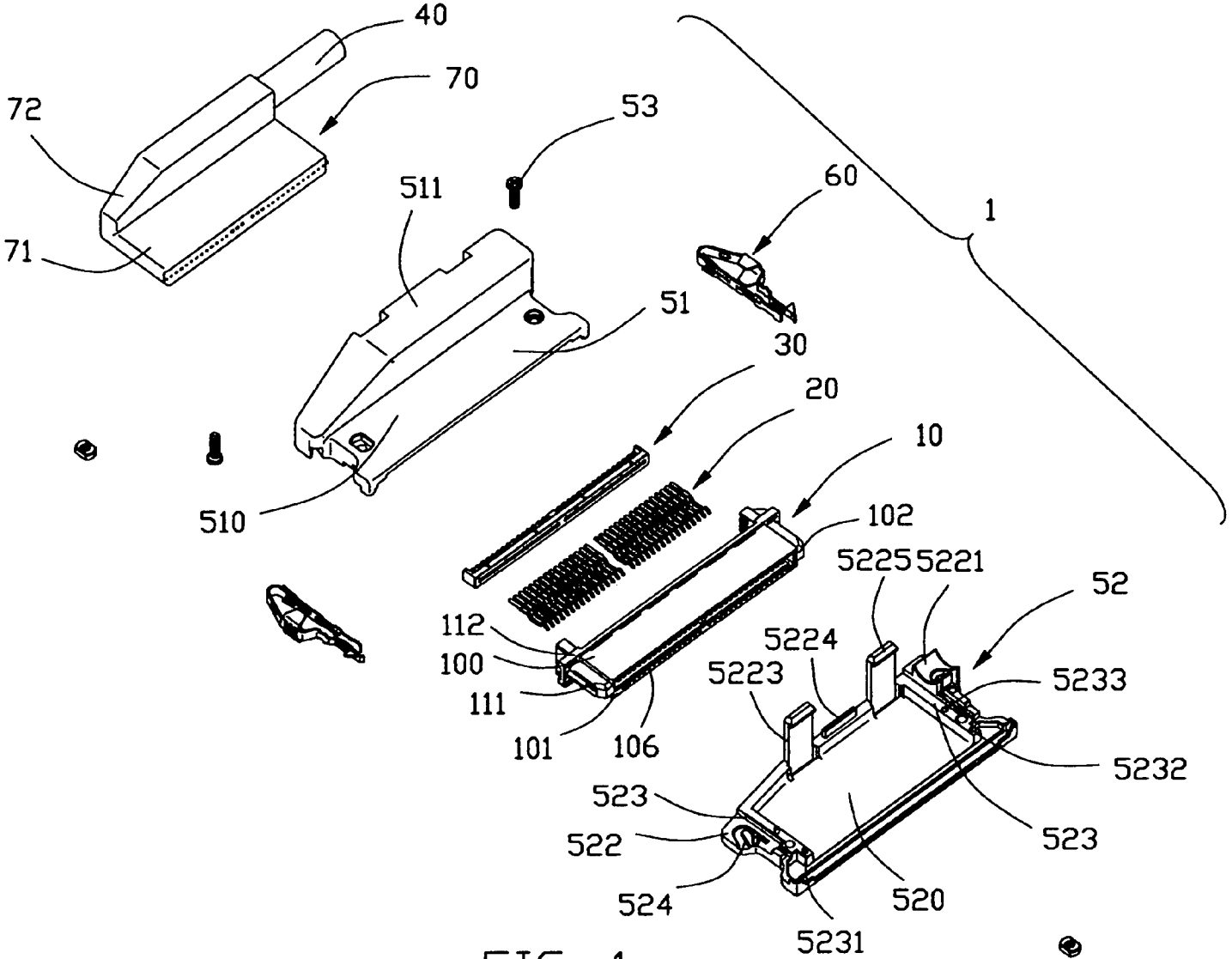
FIG. 1 is a partially exploded, perspective view of a cable end connector assembly in accordance with the present invention.

Referring to FIGS. 1 to 4, a cable assembly 1 in accordance with the present invention comprises an insulative housing 10, a plurality of contacts 20, a spacer 30, a cable 40, an insulator 70, a cover 50 and a pair of locking members 60. In the present embodiment, the cable assembly 1 is in accordance with a Serial ATA II standard. However, in alternative embodiments, the electrical connector could be provided as other types.

Figure 2:
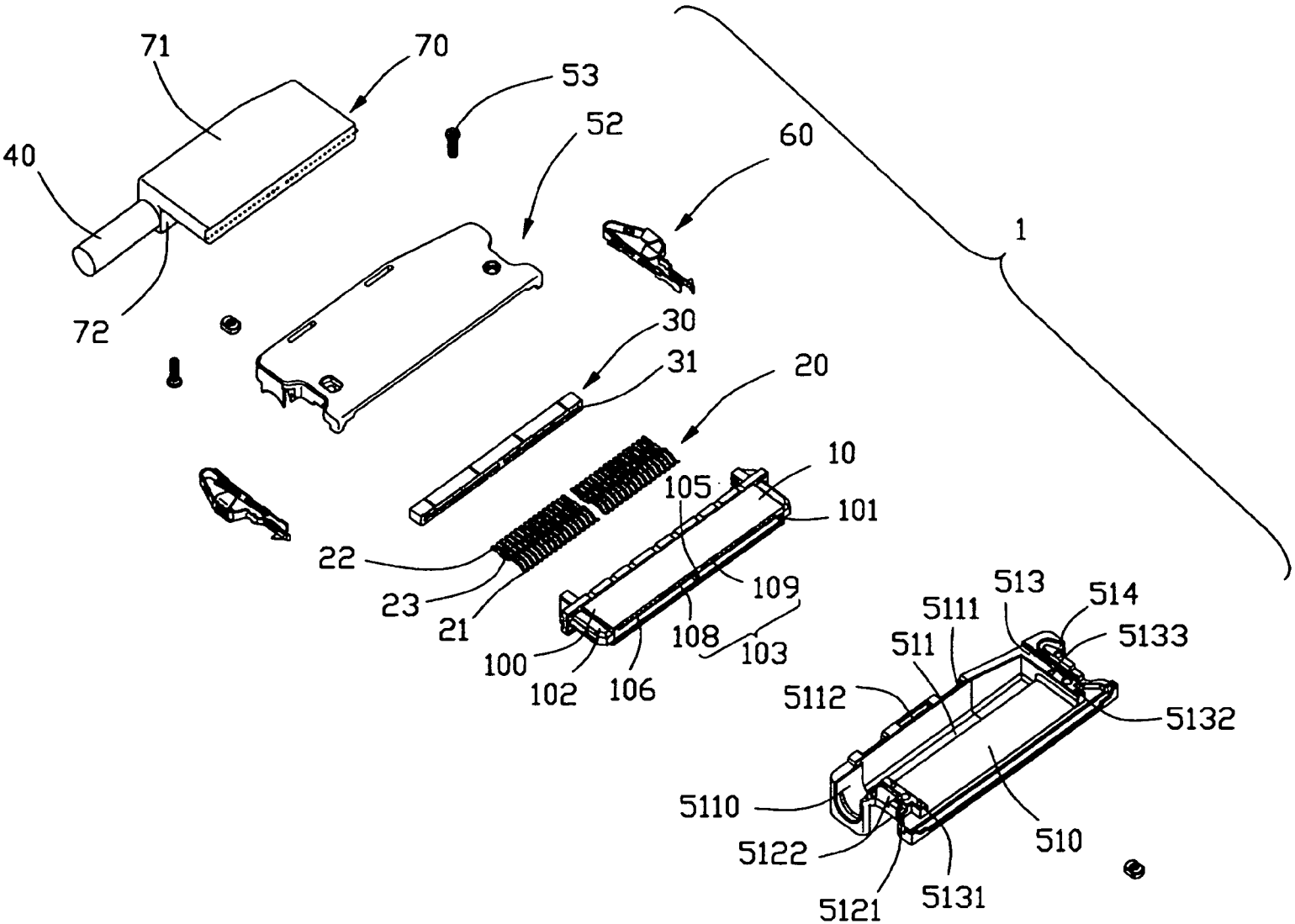
FIG. 2 is a view similar to FIG. 1, but taken from a different aspect.
Figure 3:
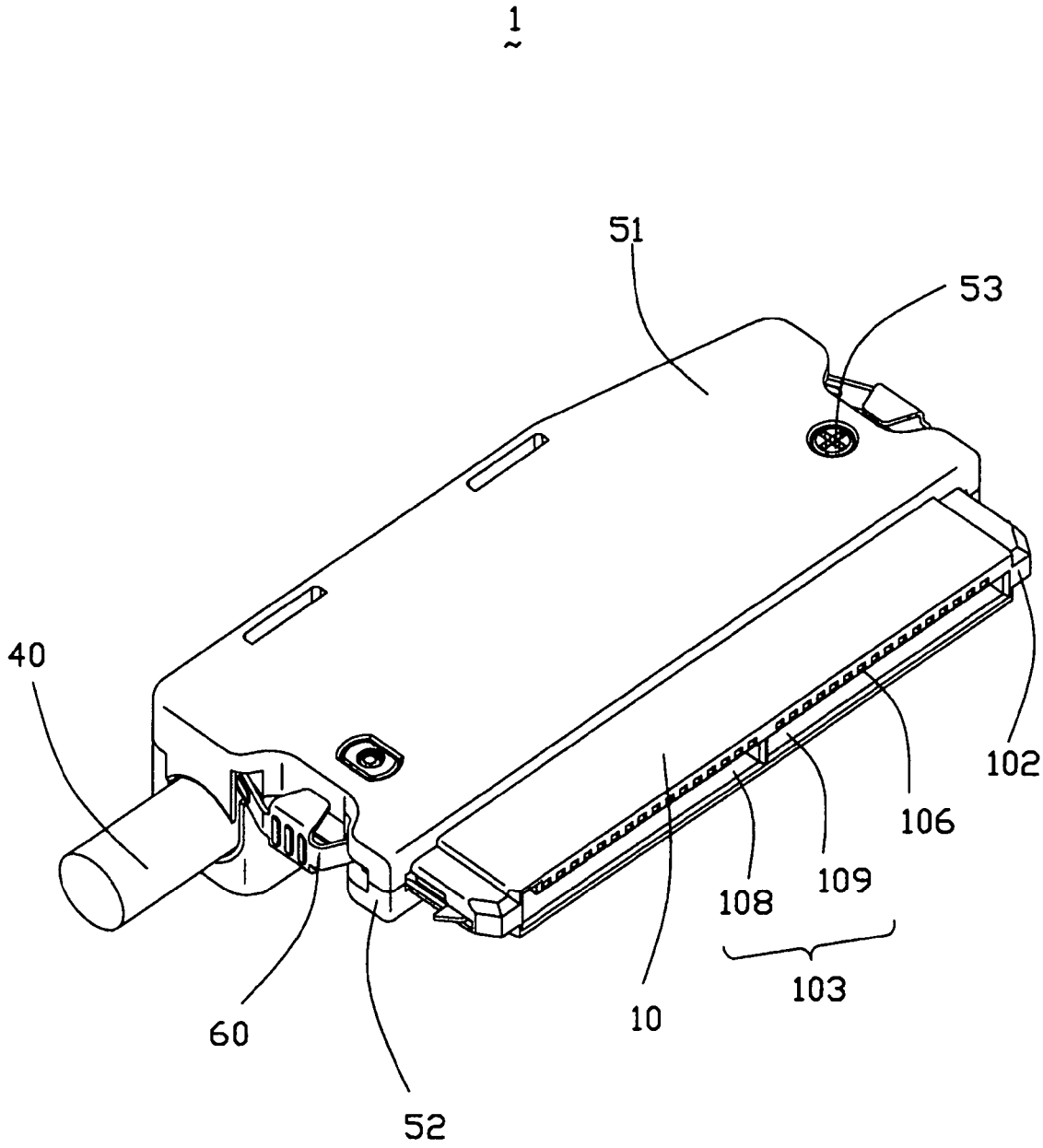
FIG. 3 is an assembled, perspective view of the cable assembly of FIG. 1.
Figure 4:
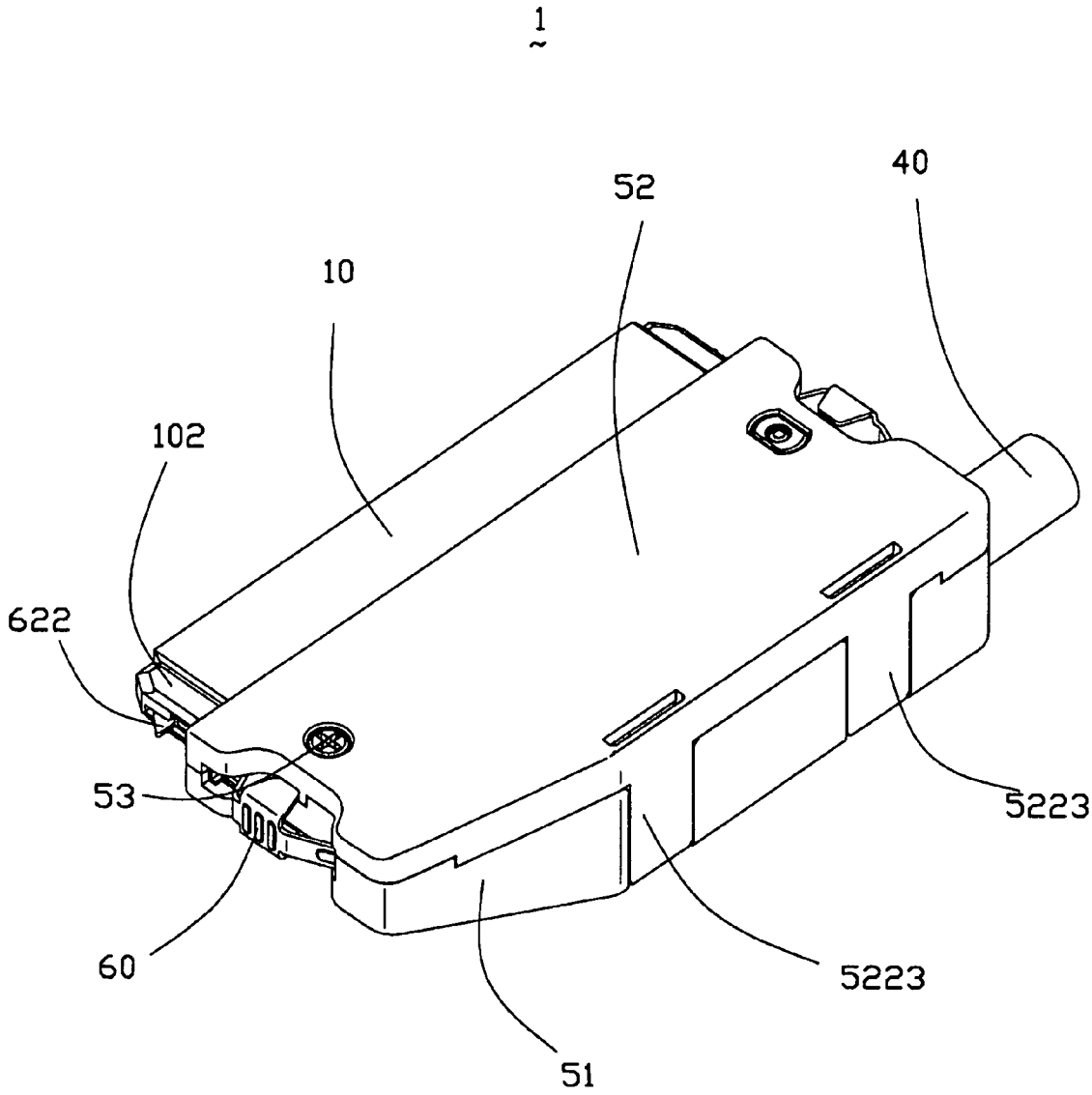
FIG. 4 is a view similar to FIG. 3, but taken from a different aspect.
Figure 5:
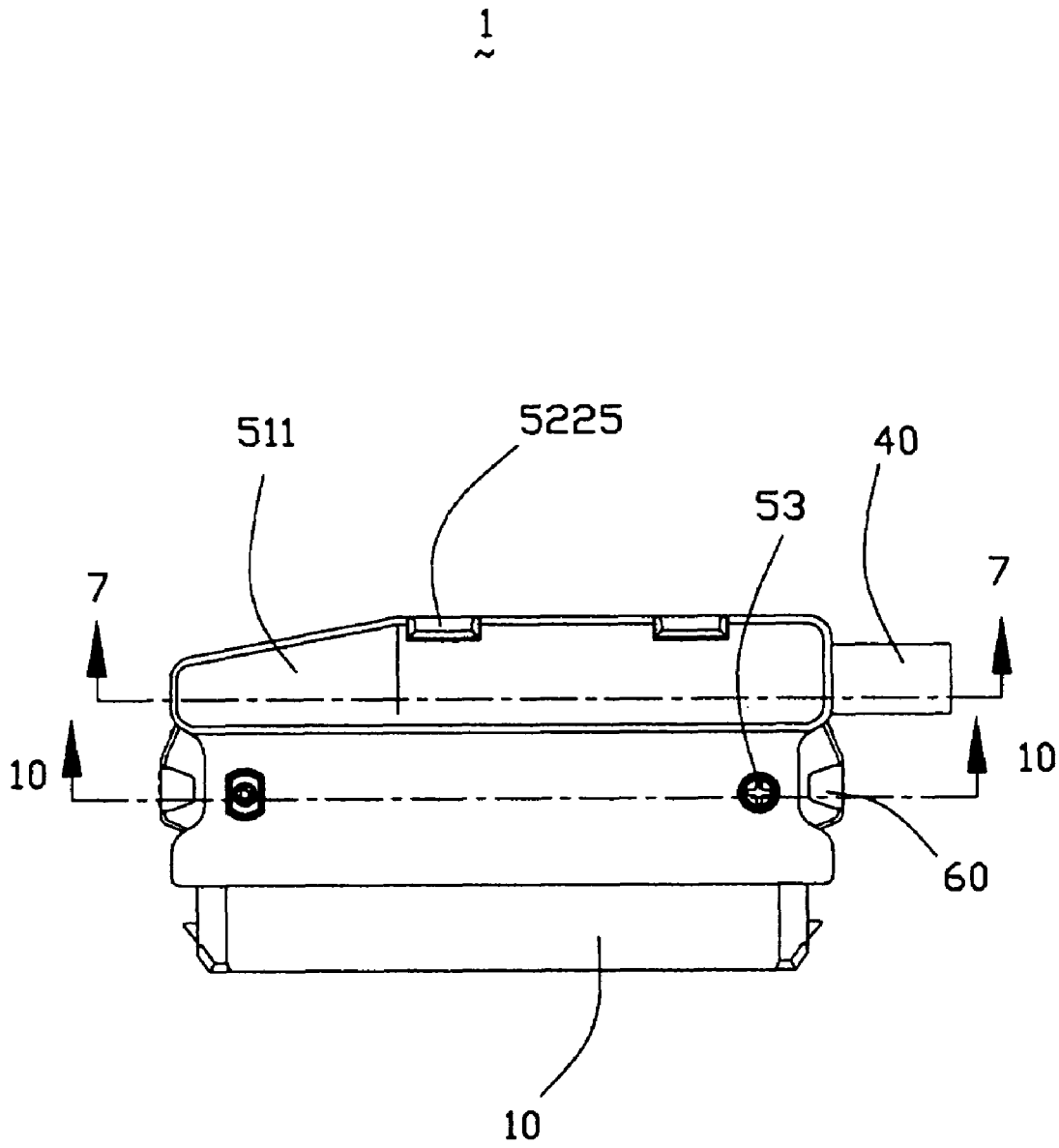
FIG. 5 is a top elevation view of the cable assembly.
Figure 6:
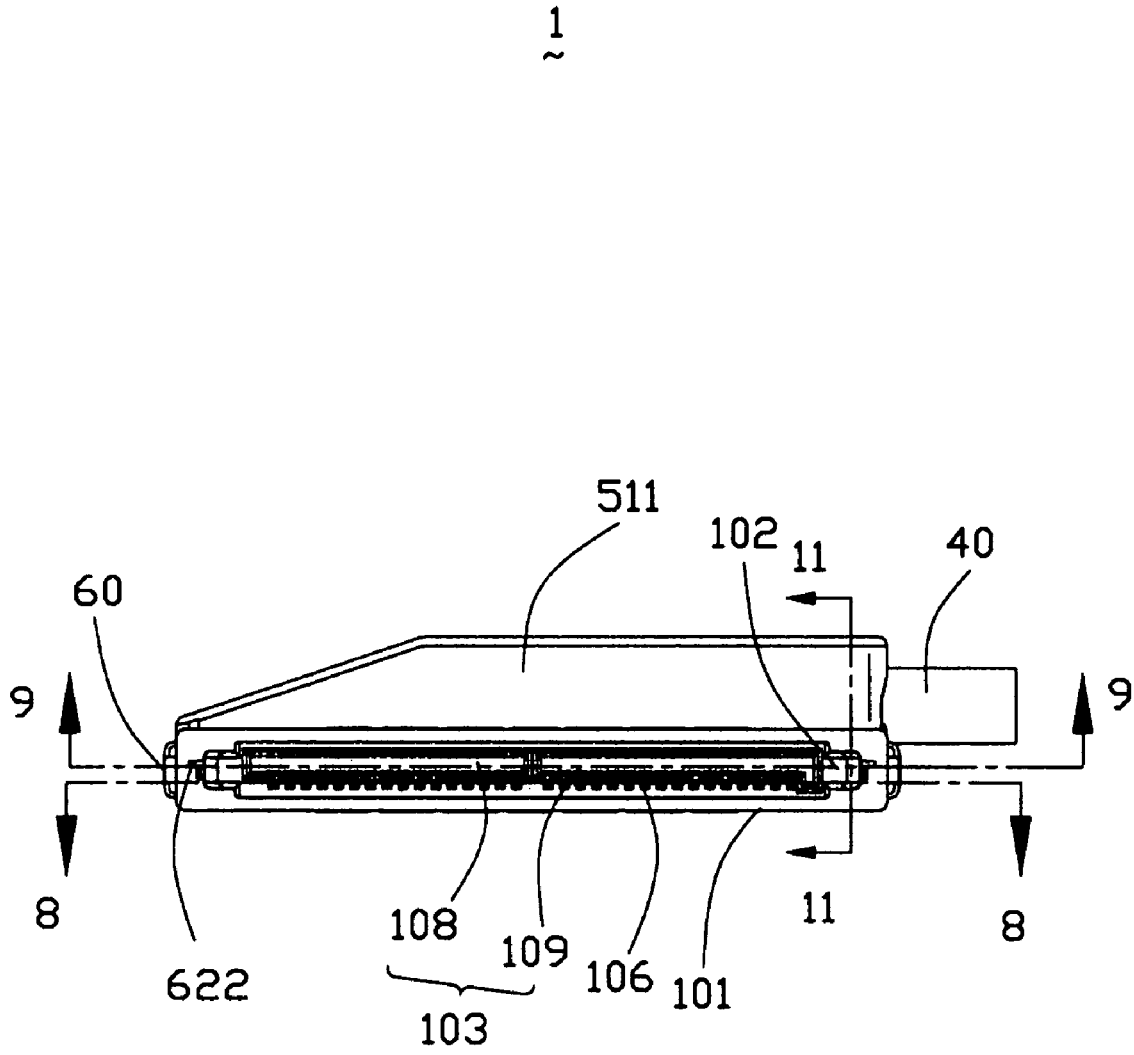
FIG. 6 is a front elevation view of the cable assembly.

Particularly referring to FIGS. 1 and 2, the insulative housing 10 comprises an upper wall 100, a lower wall 101 opposite to the upper wall 100, and a pair of side portions 102 connecting with the upper wall 100 and the lower wall 101. Between the upper and the lower walls 100, 101, the housing 10 defines a front plug receiving space 103 and a rear spacer receiving space (not shown) for respectively receiving a complementary connector (not shown) and the spacer 30. A block 105 is formed on the upper wall 100 and protrudes into the plug receiving space 103. The block 105 defines a plurality of passageways 106 extending therethrough in a front-to-back direction and communicating with the plug receiving space 103 and the spacer receiving space. The plug receiving space 103 is divided into an L-shaped first port 108 and a rectangular second port 109 by a vertically extended partition wall (not labeled) for receiving complementary connectors with different profiles. Each side portion 102 defines a retention cavity 111 opening toward outside therein for engaging with corresponding locking member 60.

Referring to FIGS. 1 and 2, the contacts 20 are received in the passageways 106 of the insulative housing 10 and each contact comprises a curved contact portion 21, a tail portion 22 and a housing retaining portion 23 connecting the contact portion 21 and the tail portion 22. The contact portions 21 extend into the L-shaped first port 108 and the rectangular second port 109 and partially exposed into the plug receiving space 103 of the housing 10, respectively.

The housing retaining portions 23 are secured within the passageways 106 of the housing 10 by an interference fit. The spacer 30 is mounted to be received in the spacer receiving space of the insulative housing 10 and seal the rear end of the housing 10, and comprises a plurality of through holes 31 for allowing the tail portions 21 of the contacts 20 extending therethrough. The spacer 30 can prevent plastic from entering into the passageways 106 of the insulative housing 10. The contacts 20 and the spacer 30 can be integrally formed before mounting to the insulative housing 10, if desired.

The cable 40 comprises a plurality of conductors (not shown) exposed outside and extending towards the spacer 30 for being soldered to corresponding tail portions 22 of the contacts 20.

The insulator 70 is over-molded on the cable 40 and received in the covers 50. The insulator 70 comprises a horizontally base portion 71 and a vertically extending distal portion 71 from the rear end of the base 71. The cable 40 is bent to a right angle structure, partially received in the distal portion 72, passing through the base 71.

Referring to FIGS. 1, 2, and 7-9, the cover 50 comprises an upper cover 51 and a lower cover 52. The upper cover 51 is of a sandglass-like configuration and comprises a body portion 510, a receiving portion 511 formed of a rear end of the body portion 510 and two side portions 512 formed at the opposite sides of the body portion 510. A first side portion 512 is separated from the body portion 510 by a beam 513, and comprises a U-shaped receiving cavity 514. A second side portion 512 is also separated from the body portion 510 by the beam 513. The second side portion 512 comprises a channel 5121 and a depressing portion 5122 behind the channel 5121. The beam 513 comprises a plurality of positioning post 5131, a plurality of positioning holes 5132 alternately disposed along a front-to-back direction, and a plurality of screw-holes 5133. The receiving portion 511 extends upwardly from the body portion 510, and is formed behind the body portion 510 and the second side portion 512 with one lateral end connecting with the first side portion 512. The receiving portion 511 defines a semicircular opening 5110 at the other lateral end thereof and opening toward outside. The upper cover 51 defines a pair of receiving channels 5111 extending from bottom face to top face of the receiving portion 511 and recessed forwardly from a rear face of the receiving portion 511. A receiving passageway 5112 is defined in the rear end of the receiving portion 511 and recesses upwardly to a distance from the bottom face of the receiving portion 511 with locating between the receiving channels 5111. The receiving portion 511 defines a pair of slots downwardly extending from the top face thereof to communicate with the pair of 5111, thus, forming a pair of step portions 5113 latching with the lower cover 52.

The lower cover 52 is also of a sandglass-like configuration and comprises a body portion 520, and two side portions 522 formed at the opposite sides of the body portion 520. The side portions 522 are separated from the body portion 520 by two beams 523 corresponding to the beams 513 on the upper cover 51, each comprises a U-shaped receiving cavity 524. The right side portion 522 further comprises a block (not labeled) projecting upwardly therefrom adjacent to rear thereof with corresponding U-shaped receiving cavity 524 is partially exposed in the block. The block defines a semicircular opening 5221 corresponding to the opening 5110 on the upper cover 51. The body portion 520 further comprises a pair of latch 5223 extending upwardly from rear edge thereof and a rectangular protrusion 5224 located between the latching blocks 5223. Each latch 5223 defines a hook 5225 at the distal end thereof for latching with the step portion 5113 of the upper cover 51. The beam 523 comprises a plurality of positioning posts 5231, a plurality of positioning holes 5232 and a plurality of screw-holes 5233.

During the upper and the lower covers 51, 52 are assembled together, the latches 5223 slide along corresponding receiving channels 5111 with the hooks 5225 engaging with the stopping portions 5113 of the upper cover 51. The protrusion 5224 is received in the receiving passageway 5112 for positioning the covers 51, 52. The semicircular opening 5221 of the lower cover 52 and the semicircular opening 5110 of the upper cover 51 together form a circular opening (not labeled). Each positioning post 5131, 5231 of upper cover and lower cover 51, 52 extending into corresponding positioning hole 5232, 5132 of the lower cover 52 and upper cover 51 to align the upper and the lower cover 51, 52. The screw-holes 5133, 5233 align with one another in an up-to-down direction and together define two screw-passageways (not labeled) for letting a pair of screw 53 go through, thus, the upper cover 51 and the lower cover 52 are retained with each other. The U-shaped receiving cavity 514, 524 on the upper cover 51 and the lower cover 52 together define a second retention cavity 55 (FIG. 7) communicating with the first retention cavity 111 of the housing 10 along the front-to-back direction.

Figure 10:
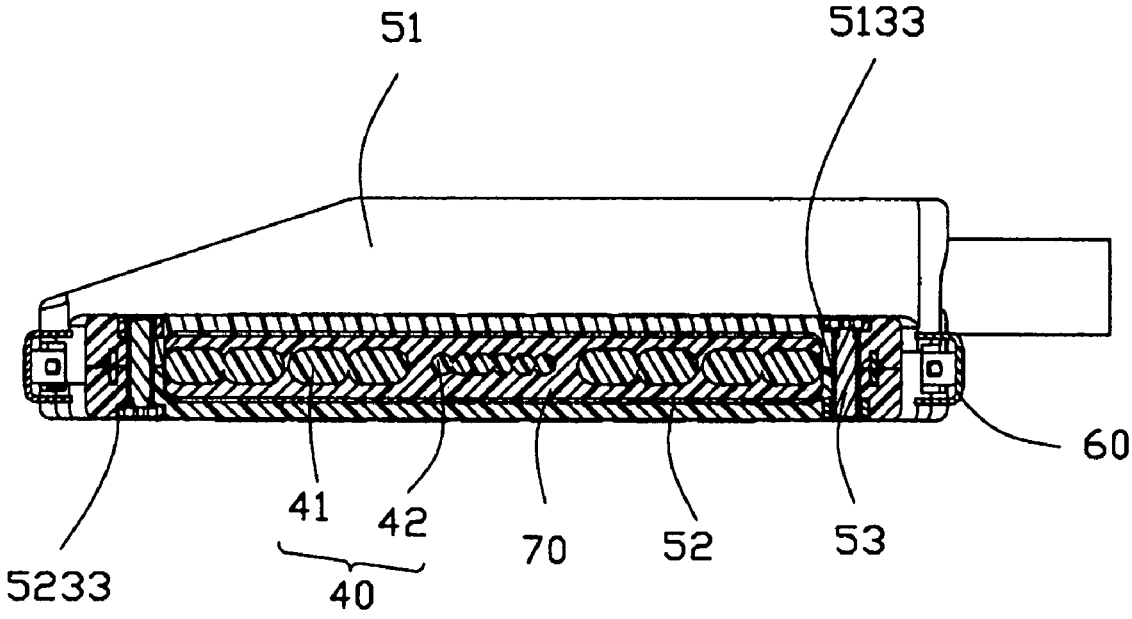
FIG. 10 is a cross-sectional view taken along line 10-10 of FIG.
Figure 11:
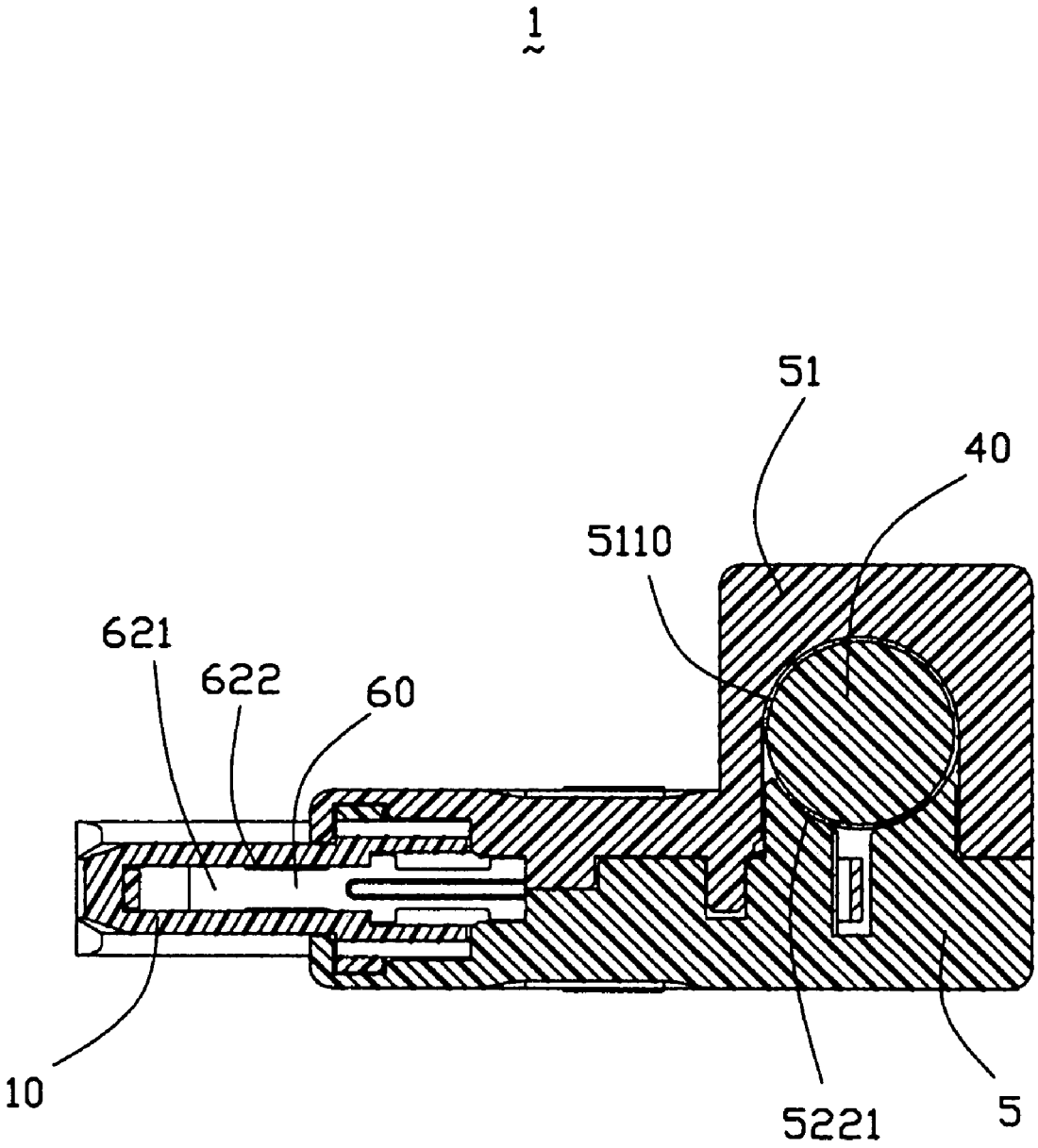
FIG. 11 is a cross-sectional view taken along line 11-11 of FIG.
Figure 12:
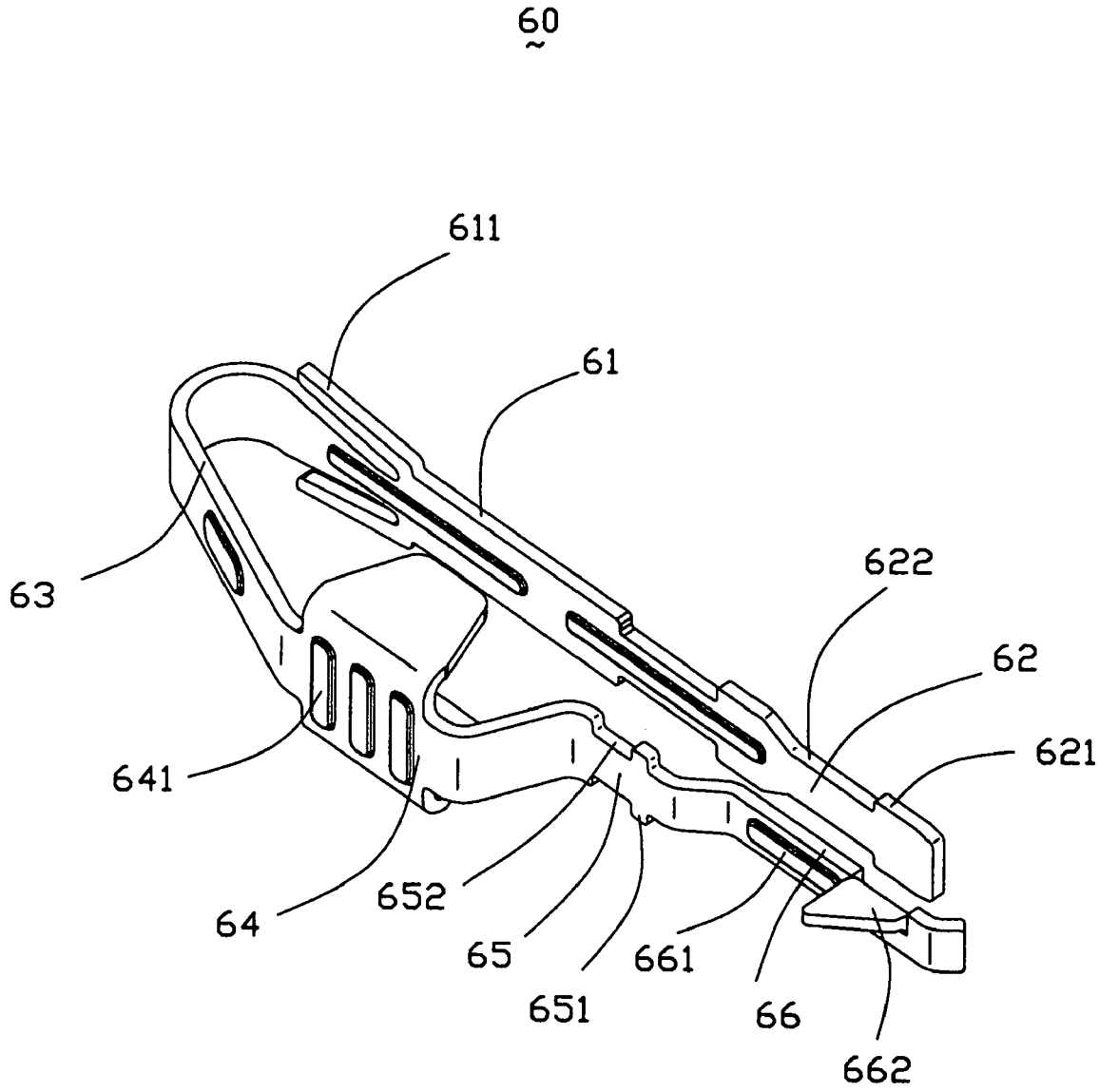
FIG. 12 is an enlarged view of a locking member shown in FIG. 1.
Figure 13:
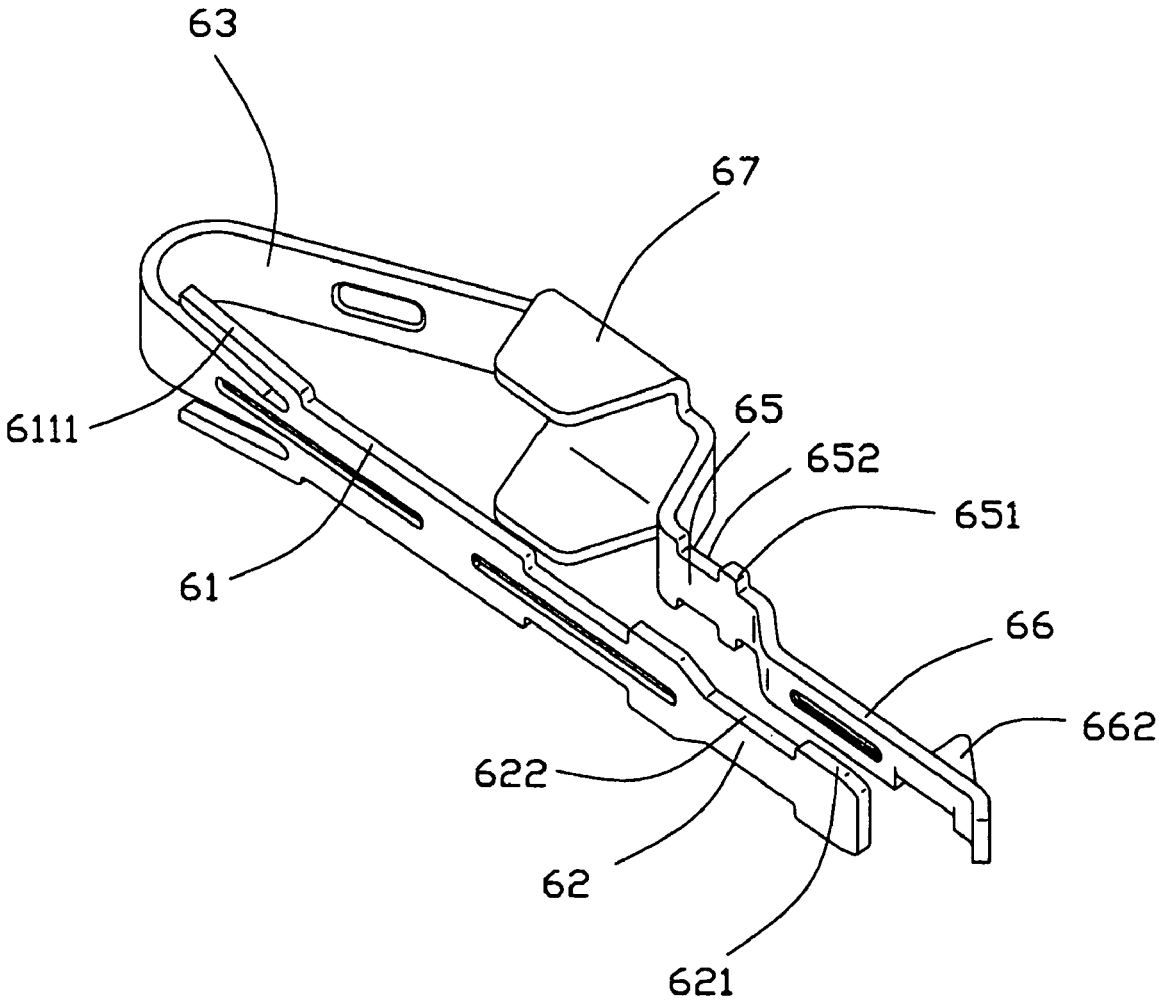
FIG. 13 is a view similar to FIG. 5, but taken from a different aspect.

Referring to FIGS. 10 and 11, each locking member 60 is stamped and formed from a metallic plate and comprises an elongate, housing retention section 62 extending along the front-to-back direction, a cover retention section 61 extending rearwardly from the housing retention section 62, a spring section 63 extending slantways from the cover retention section 61, a flat pushing section 64 extending forwardly from the spring section 63, an L-shaped positioning section 65 extending forwardly from the pushing section 64, and a latch section 66 extending forwardly from the positioning section 65. The housing retention section 62 are partially cut to form a pair of recesses 622, thus, also forms two pairs of retention tabs 621 at middle and a tip end thereof. The cover retention section 61 defines a pair of retention tabs 611 slantways extending from opposite upper and lower edges thereof for engaging with the cover 50. The pushing section 64 defines a plurality of protrusions 641 on an outer surface thereof for handling concentrically. A pair of stopping sections 67 extends towards the cover retention section 61 from opposite sides of the pushing section 64. The positioning section 65 comprises a pair of positioning tabs 651 and a pair of recesses 652 for assuring fixed assembly. The latch section 66 comprises a protrusion portion 661 lengthwise extending from outer surface thereof and a locking tab 662 bent and extending outwardly.

Figure 7:
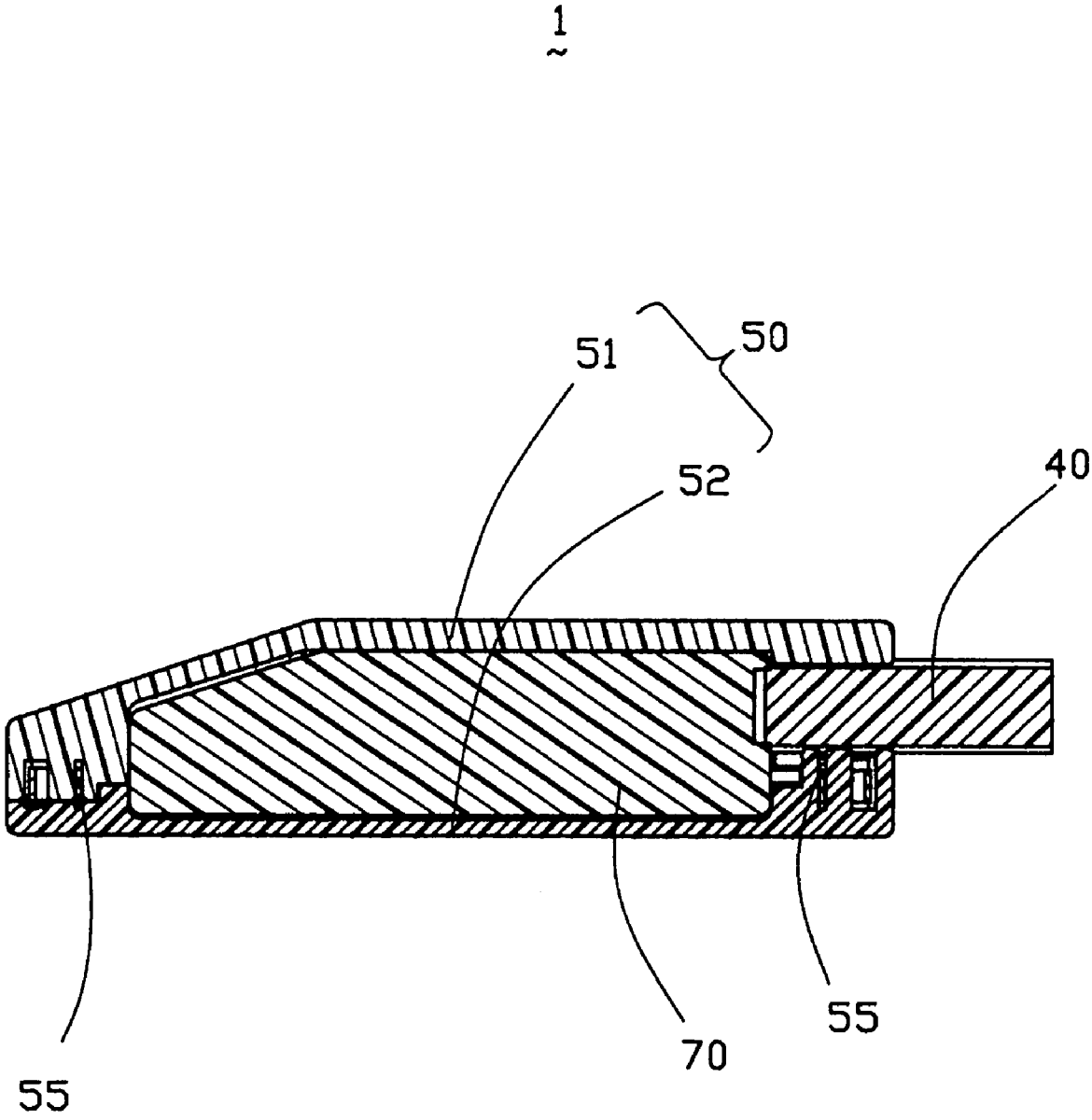
FIG. 7 is a cross-sectional view taken along line 7-7 of FIG. 5.
Figure 8:
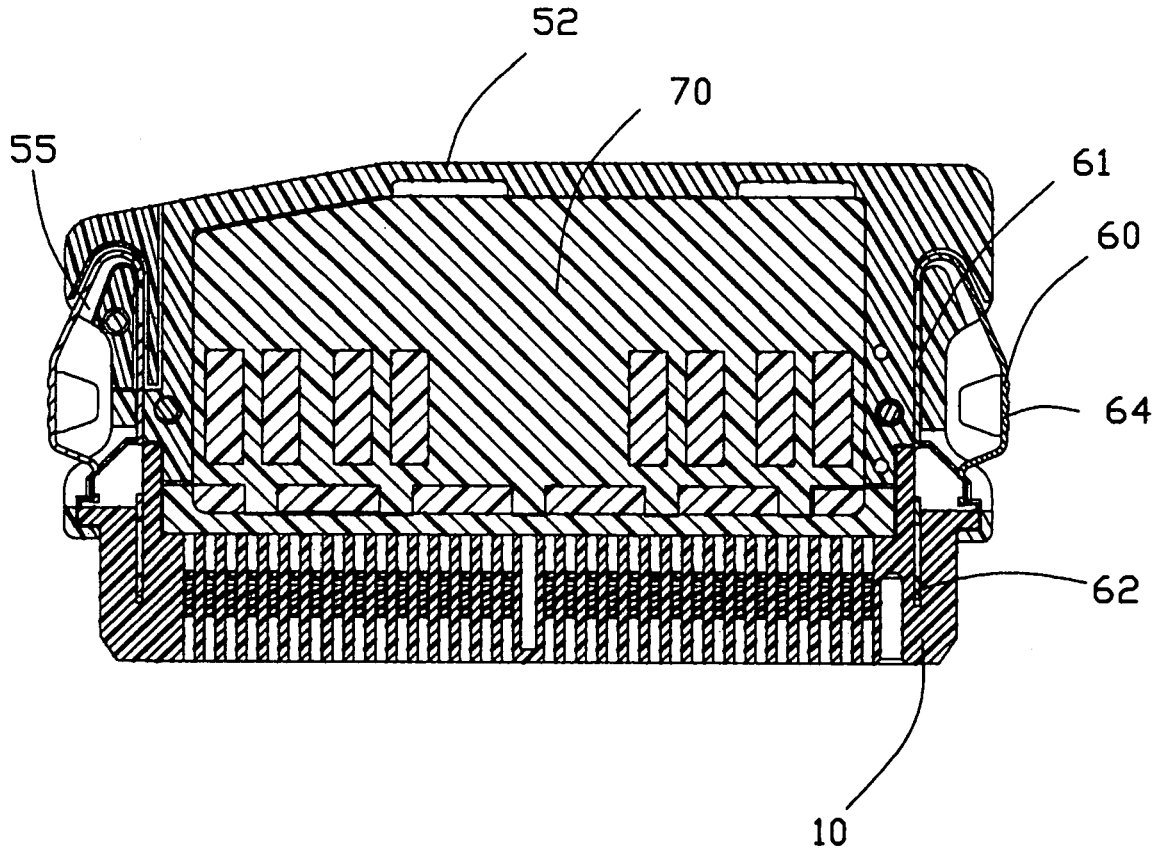
FIG. 8 is a cross-sectional view taken along line 8-8 of FIG. 4
Figure 9:
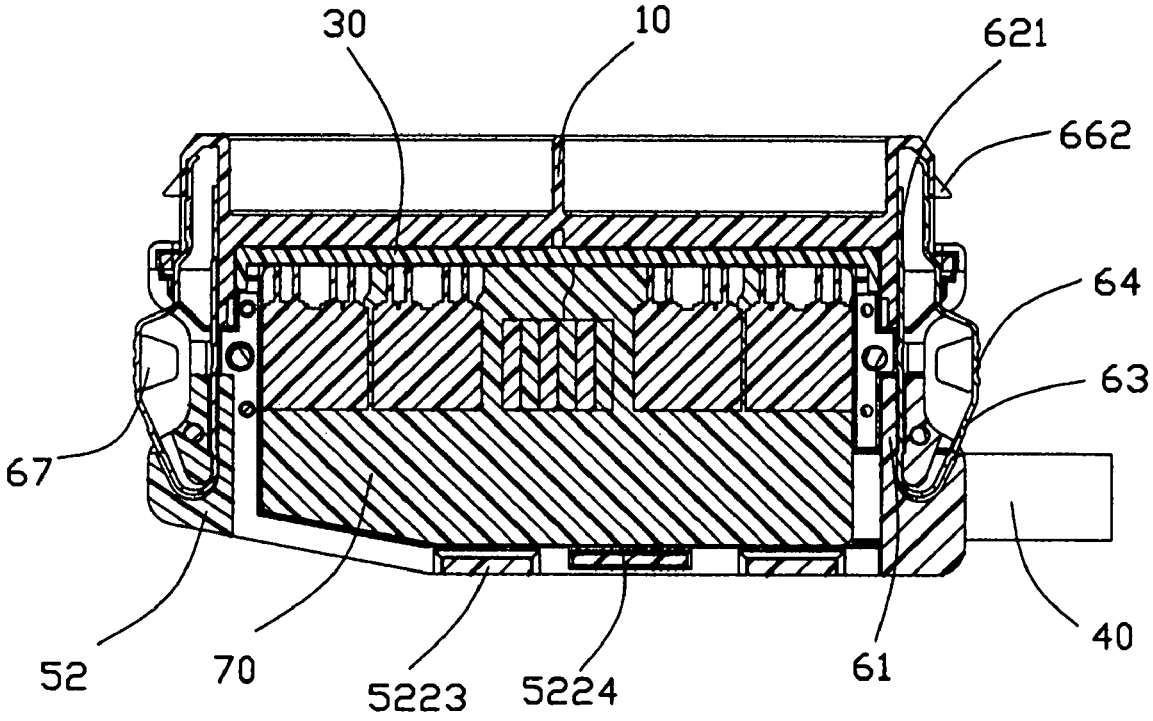
FIG. 9 is a cross-sectional view taken along line 6-6 of FIG.

Referring to FIGS. 7 to 9, the housing retention section 62 of the latching member 60 is received in the first retention cavity 111 of the housing 10 with the retention tabs 621 engaged with upper and lower surface thereof. The cover retention section 61 is received in the second retention cavity 55 of the cover 50 with the retention tabs 611 securely retained in the cover 50. The pushing section 64 and the stopping sections 67 are located in the outer depression (not labeled) of the cover 50, and the stopping section 67 extends towards the cover 50. The latch section 66 is received in the first retention cavity 111 of the housing 10 and the locking tab 662 projects outside the housing 10. The base 71 of the insulator 70 is received in the body portion 510 of the covers 50, the distal portion 72 of the insulator 70 is received in the receiving portion 511 of the upper cover 51 with the cables 40 passing through the circular opening (not labeled) of the cover 50 to present right angle shape. When the cable assembly 1 mates with the complementary connector, an inward pressing force is firstly exerted on the pushing sections 64 of the locking members 60 by user's fingers to drive the latch sections 66 to move inwardly. Once the pressing force is released, the latch section 66 restore to its original position due to their own elasticity, and thus, locks with the complementary connector through the locking tab 622. The positioning tabs 651 of the positioning sections 65 abut against the housing 10 for assuring a reliable mating between the cable end connector assembly 1 and the complementary connector. When the cable end connector assembly 1 is to be disengaged from the complementary connector, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly mating with a complementary connector in a front-to-back direction, comprising:

an insulative housing defining a pair of first retention cavities;

a plurality of contacts disposed in the housing;

a cable extending along a left-to-right direction perpendicular to the front-to-back direction with a plurality of conductors;

an insulator received in the insulative housing, and comprising a base enclosing the conductors and a distal portion extending from the base;

a pair of covers assembled on a rear portion of the housing and enclosing the insulator, and defining a body portion, a receiving portion extending upwardly from the body portion and a pair of opposite side portions with a pair of U-shaped second retention cavities therein, respectively, the base of the insulator being received in the body portion, and the distal portion of the insulator being received in the receiving portion, the first retention cavities aligned with the corresponding second retention cavities in the front-to-back direction; and a pair of locking members received in the second retention cavities of the covers and extending into the first retention cavities of the housing.

2. The cable assembly as described in claim 1, wherein the cable extends into the distal portion of the insulator in the left-to-right direction with the conductors passing out of the base portion of the insulator along the front-to-back direction.

3. The cable assembly as described in claim 1, wherein the cover comprises an upper cover and a lower cover.

4. The cable end connector assembly as described in claim 3, wherein the upper and the lower cover are assembled on the housing along a vertical direction perpendicular to the front-to-back direction.

5. The cable assembly as described in claim 4, wherein the upper and the lower covers are retained together by a screw.

6. The cable assembly as described in claim 5, wherein the upper cover comprises a body portion, and two side portions are formed at opposite sides of the body portion, each side portion comprises an U-shaped receiving cavity.

7. The cable assembly as described in claim 6, wherein the lower cover comprises a body portion, and two side portions are formed at opposite sides of the body portion, each side portion comprises an U-shaped receiving cavity, and the receiving cavities on the upper cover and lower cover together form said second retention cavities.

8. The cable end connector assembly as described in claim 7, wherein the upper and lower cover comprises a positioning post and a positioning hole formed on respective inner surface and the positioning post extends into the positioning hole for position the upper and lower covers in right place.

9. The cable assembly as described in claim 8, wherein the side portions of the upper and the lower covers, each comprises a screw-hole, and said screws pass through the screw-holes on the upper and lower covers.

10. The cable assembly as described in claim 9, wherein the upper and the lower covers comprise a semi-circular opening, respectively, and forms a circular opening together for letting the cable extend out of the cover.

11. The cable assembly as described in claim 1, further comprises a spacer mounted on a rear end of the housing, and wherein the contacts extend through the spacer.

12. The cable assembly as described in claim 1, wherein the housing defines a receiving space therein and a partition wall extending along a longitudinal direction, the receiving space is divided by a partition wall into two ports.

13. The cable end connector assembly as described in claim 10, wherein one of the two ports of the housing is L-shaped.

14. The cable end connector assembly as described in claim 1, wherein the cable is located in a higher level than the housing in an up-to-down direction perpendicular to the left-to-right and the front-to-back direction.

15. A cable connector assembly comprising:

an insulative housing defining a mating port in a front portion;

a plurality of contacts disposed in the housing and communicating with the mating port;

a round cable including a plurality of wires located behind a rear portion of the housing; and an insulator enclosing a conjunction portion of the cable with regard to the housing; wherein the insulator essentially defines, along a front-to-back direction, generally an L-shaped cross-section including a horizontal section parallel to and aligned with the housing so as to disperse the wires, and a raised section above said horizontal section so as to allow the round cable to extend therefrom in a direction parallel to the horizontal section and along a longitudinal direction of said mating port.

16. The assembly as claimed in claim 15, wherein said raised section defines a chamfer section around one end opposite to the other end from which said round cable extends.

17. The assembly as claimed in claim 16, further including a cover defining generally an L-like cross-sectional configuration to enclose said insulator.

18. The assembly as claimed in claim 17, wherein the cover defines a chamfer on one side opposite to a side which said round cable located on.

* * * * *